US006053513A

United States Patent [19]

Dickinson

[11] Patent Number: 6,053,513

[45] Date of Patent: Apr. 25, 2000

[54] MULTIPLE SEGMENT PIVOTING SNOWBOARD

[76] Inventor: Sean Dickinson, 2802 NW. 60th Ter., Apt. 162-6, Sunrise, Fla. 33313

[21] Appl. No.: 09/135,535

[22] Filed: Aug. 17, 1998

Related U.S. Application Data

[60] Provisional application No. 60/043,272, Aug. 17, 1997.

[51] Int. Cl.[7] ..... B62B 13/04

[52] U.S. Cl. ..... 280/14.2; 280/603; 280/606; 280/15; 280/16; 280/20

[58] Field of Search ..... 280/14.2, 87.041, 280/87.042, 603, 601, 606, 607, 16, 17, 15, 20, 22; 441/65, 74, 68

[56] References Cited

U.S. PATENT DOCUMENTS

| | | | |
|---|---|---|---|
| 3,372,944 | 3/1968 | Lauritzen | 280/17 |
| 3,856,318 | 12/1974 | Hollenbeck | 280/28 |
| 4,138,128 | 2/1979 | Criss | 280/16 |
| 4,161,323 | 7/1979 | Wetteland | 280/7.12 |
| 4,163,565 | 8/1979 | Weber | 280/16 |
| 4,221,394 | 9/1980 | Campbell | 280/12 H |
| 4,243,238 | 1/1981 | Johnson | 280/20 |
| 4,725,069 | 2/1988 | Stampacchia et al. | 280/607 |
| 5,249,816 | 10/1993 | Southworth | 280/14.2 |
| 5,411,282 | 5/1995 | Shannon | 280/606 |
| 5,540,455 | 7/1996 | Chambers | 280/87.042 |
| 5,618,051 | 4/1997 | Kobylenski | 280/14.2 |
| 5,865,446 | 2/1999 | Kobylenski | 280/14.2 |

*Primary Examiner*—Richard M. Camby
*Attorney, Agent, or Firm*—Oltman, Flynn & Kubler

[57] ABSTRACT

A snowboard is provided for riding over snow, including a front board member having a front board forward end and a front board rearward end; a rear board member having a rear board forward end and a rear board rearward end; and a hinge assembly interconnecting the front board member rearward end and the rear board member forward end. The rear board member preferably overlaps the front board member so that the front board rearward end is underneath the rear board forward end to minimize drag at the joint when the snowboard moves over snow in a forward direction.

3 Claims, 2 Drawing Sheets

MULTIPLE SEGMENT PIVOTING SNOWBOARD

This application is based on provisional application No. 60/043,272 filed on Aug. 17, 1997.

BACKGROUND OF THE INVENTION

1. Field of the Invention

The present invention relates generally to the field of non-powered, surface skimming vehicles such as skis, surfboards and specifically snowboards. A snowboard is a long continuous surface platform made from a variety of materials designed to capture certain aspects of surfing on snow. When using a snowboard, the rider has a sensation of gliding over a surface and shifting one's body weight from one side of the board to the other in order to execute a turn in either direction. In surfing, the execution and completion of a turn relies on the surface hull design (single concave, double concave), fins (single, double, triple), and overall body design (teardrop, asymmetrical). The execution of a turn with a snowboard is based on the flex and shape of the bow of the board and the ratio of the width of the bow to the width of the waist. The completion of the turn is based on a mixture of the flex and shape of the tail and the ratio of the width of the tail to the width of the waist. Ideally, a turn with a snowboard is initiated applying pressure to the downhill foot and leaning down and into the side of the board one wishes to turn.

Snowboarding attempts to capture aspects of surfing. Because of the snowboard's inherent design limitations, it does not attain certain performance parameters in the hands of the average user. Specifically, short radius turns and high-frequency edge-to-edge turns are difficult and not attainable for the recreational user. In addition, the time to learn how to use a snowboard can be long and frustrating, causing some users to avoid attempts to learn. Control of the board is essential and time consuming to master. As noted above, control relies on shifting weight and movement of the uphill foot from side to side to assist in the turn cycle. It would be desirable to provide a system for guiding an apparatus on a surface, such as snow, that provides the sensation of surfing, i.e., leaning from side to side to carry out a turn, as well as edge-to-edge control that allows a user to achieve a sensation of cutting up and down the face of a wave while minimizing the loss of vertical feet. Preferably, such a device would allow the first-time user to readily master the necessary skills which would further promote usage of the device.

The present invention relates to an improved snowboard apparatus. The snowboard apparatus includes two separate boards interconnected by a hinge in such a manner that, when the boards are together and mutually aligned, they resemble a traditional snowboard. Connected to the top of the board are bindings: a front binding on the front board and a rear binding on the rear board. The boards in combination have a smooth bottom to improve the apparatus sliding ability on snow. The rear board overlies the front board providing a joint configured to permit the snowboard to slide forwardly without the rear board acting as an abutment. The edges of the apparatus are metal to improve the carving of turns and improve the durability. The ends of the apparatus are metal to improve the carving of turns and improve the durability. The ends of the apparatus may be turned up to help the apparatus ride over thick snow.

The apparatus deviates from and improves upon the snowboard design primarily in its central hinge assembly.

The hinge allows the front to travel in a different angle than the back. In addition, as the hinge is spring-loaded, the apparatus will return to a straight orientation when torque is not applied.

2. Description of the Prior Art

There have long been snowboards for gliding over inclined snow surfaces with some degree of maneuverability.

The basic design of a snowboard is a long flat board onto which riders can attach their feet. The edges of the boards are often metal to help the snowboard carve the snow. Most snowboards have a somewhat hourglass shape when observed from the top or bottom; that is, the front and back are wide and the width tapers at the middle. The hourglass shape helps the snowboard flex. The hourglass shape also helps the edge remain more completely in contact with the snow during turns. The ability of the edge to remain in contact with the snow enhances the snowboard's stability and grip throughout the turn.

Many improvements on the basic design of the snowboard have been made. A variety of improvements embodying two in-line snowboards—a front one and a rear one, connected by an elevated strut upon which the rider stands, have been provided. These types of snowboards tend to operate like two separate snowboards. Another typical feature of these embodiments is that the rider stands on top of the strut about six inches above the surface of the snow.

Specific prior art references include snowboard and ski devices made up of two separate boards interconnected by an overhead user support platform. The forward end of the overhead platform extends over and is connected to the forward board by a pivoting bracket. The rearward end of the overhead platform extends over and is connected to the rearward board by another pivoting bracket. These include Stampacchia, et al., U.S. Pat. No. 4,725,069, issued on Feb. 16, 1988 for a ski structure; Campbell, U.S. Pat. No. 4,221,394, issued on Sep. 9, 1980 for a snow vehicle; Weber, U.S. Pat. No. 4,163,565, issued on Aug. 7, 1979, for a snow ski apparatus and method of making the apparatus; Wetteland, U.S. Pat. No. 4,161,323, issued on Jul. 17, 1979, for a snow ski board apparatus; Criss, U.S. Pat. No. 4,138,128, issued on Feb. 6, 1979, for a ski board; Shannon, U.S. Pat. No. 5,411,282, issued on May 2, 1995 for a system for guiding an apparatus over a surface; Lauritzen, U.S. Pat. No. 3,372,944, issued on Mar. 2, 1968; Southworth, U.S. Pat. No. 5,249,816, issued on Oct. 5, 1993, for a ski board; and Hollenbeck, U.S. Pat. No. 3,856,318, issued on Dec. 24, 1974, for an articulated multiple section snowboard ski. The elevated user supporting platforms of these references all raise the user center of gravity and thus diminish stability and maneuverability. Other references include Chambers, U.S. Pat. No. 5,540,455, issued on Jul. 30, 1996, for an articulated skateboard with a springable connector, teaches two longitudinally aligned boards interconnected by a hinge structure to pivot vertically; and Johnson, U.S. Pat. No. 4,243,238, issued on Jan. 6, 1981, for a sled including two sled segments longitudinally interconnected by a hinge structure permitting pivoting both laterally and vertically.

It is thus an object of the present invention to provide a snowboard apparatus which is made up of two longitudinal boards interconnected by a pivot joint to pivot laterally relative to each other, so that the snowboard maintains better contact with the snow.

It is another object of the present invention to provide such an apparatus in which the boards pivot to aim the forward end of the snowboard into a turn for improved handling and stability by keeping more of its edge on the snow, and for executing sharper turns than were possible with prior snowboards.

It is still another object of the present invention to provide such an apparatus to which the rider attaches directly via bindings, rather than to an elevated platform, so that the rider maintains a lower center of gravity for improved stability, and the movements of the rider are transmitted more directly to the board for improved precision.

A still further object of the present invention is to provide such an apparatus which forms one continuous edge between the front board and the rear board, to maximize the length of the edge that is in contact with the snow for enhanced stability and edge hold, and so that the snowboard behaves in a manner for which customary snowboarders are prepared.

It is finally an object of the present invention to provide such an apparatus which is reliable and relatively inexpensive to manufacture.

SUMMARY OF THE INVENTION

The present invention accomplishes the above-stated objectives, as well as others, as may be determined by a fair reading and interpretation of the entire specification.

A snowboard is provided for riding over snow, including a front board member having a front board forward end and a front board rearward end; a rear board member having a rear board forward end and a rear board rearward end; and a hinge assembly interconnecting the front board member rearward end and the rear board member forward end.

The rear board member preferably overlaps the front board member so that the front board rearward end is underneath the rear board forward end to minimize drag at the joint when the snowboard moves over snow in a forward direction. The hinge assembly preferably includes a floating runner including an upright tubular member having a mitered lower end; a rear board runner secured to the rear board forward end and including an upright tubular member having a mitered upper end, so that the front board and the rear board are mutually aligned when they are overlapped and the bottom surfaces of the front board and the rear board are substantially co-planar to lie evenly against snow; a tension nut having a female thread and being secured onto the upper face of the front board rearward end; a tension screw having a male thread that complements the female thread of the tension nut; a tension spring; where the tension screw extends through the tension spring, through the floating runner, through the rear board runner, and engagingly into the tension nut; and a fixing structure fixing the floating runner against rotation relative to the tension nut; so that upon rotating the front board member relative to the rear board member and out of mutual alignment, the mitering of the floating runner and of the rear board runner causes the tension spring to compress and exert pressure against the rear board runner, thereby biasing the rear board member to move toward mutual alignment with the front board member.

The fixing structure optionally includes a groove extending within the tension nut and a tongue protruding within the floating runner fitting into said groove. The floating runner and the rear board runner are mitered so that when they are overlapped and so that when the front board member and the rear board member are mutually aligned, the front board and rear board bottom surfaces are substantially co-planar.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
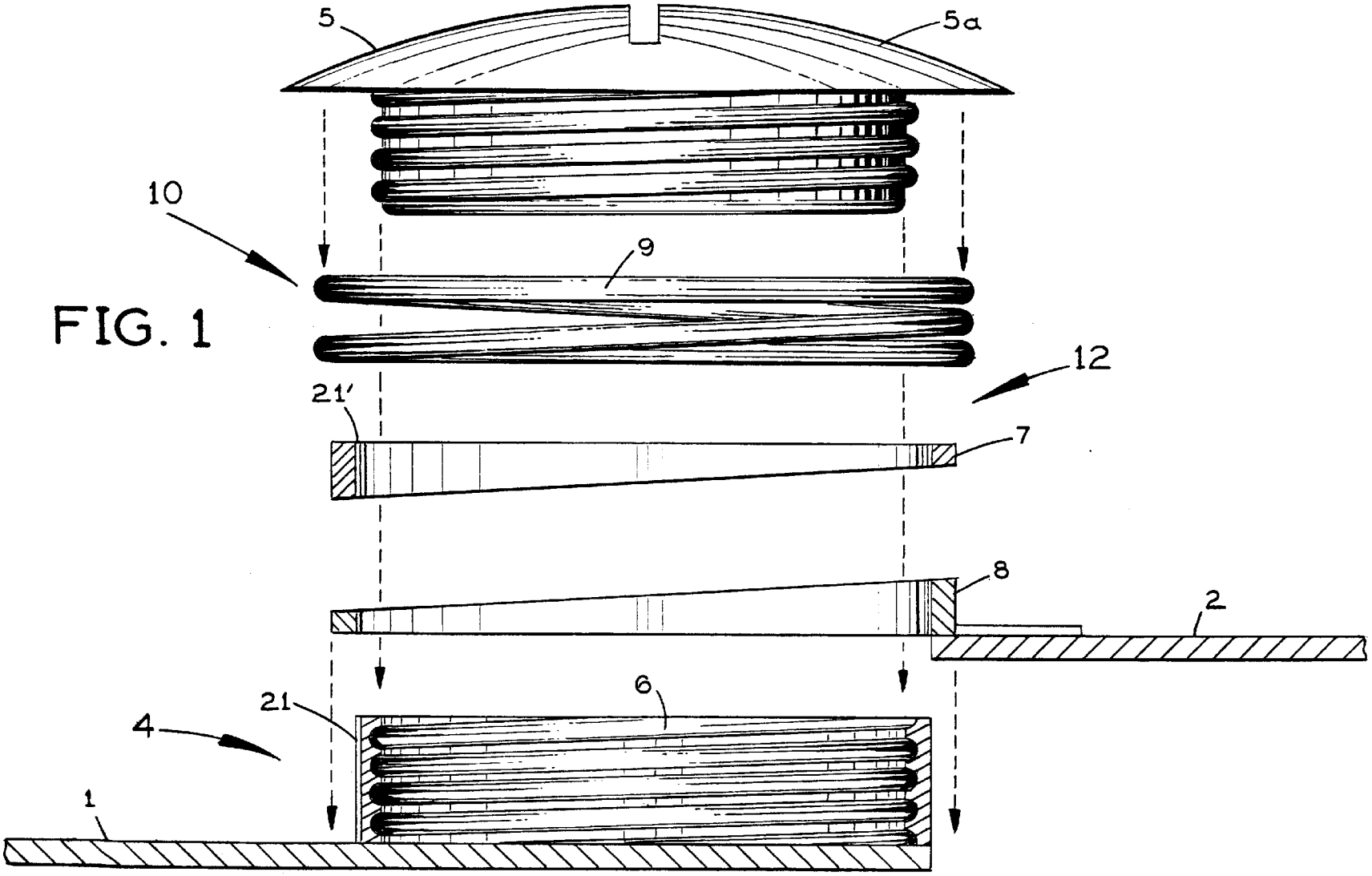
FIG. 1 is a side, exploded view of the preferred apparatus hinge assembly at the joint between the front board and the rear board.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
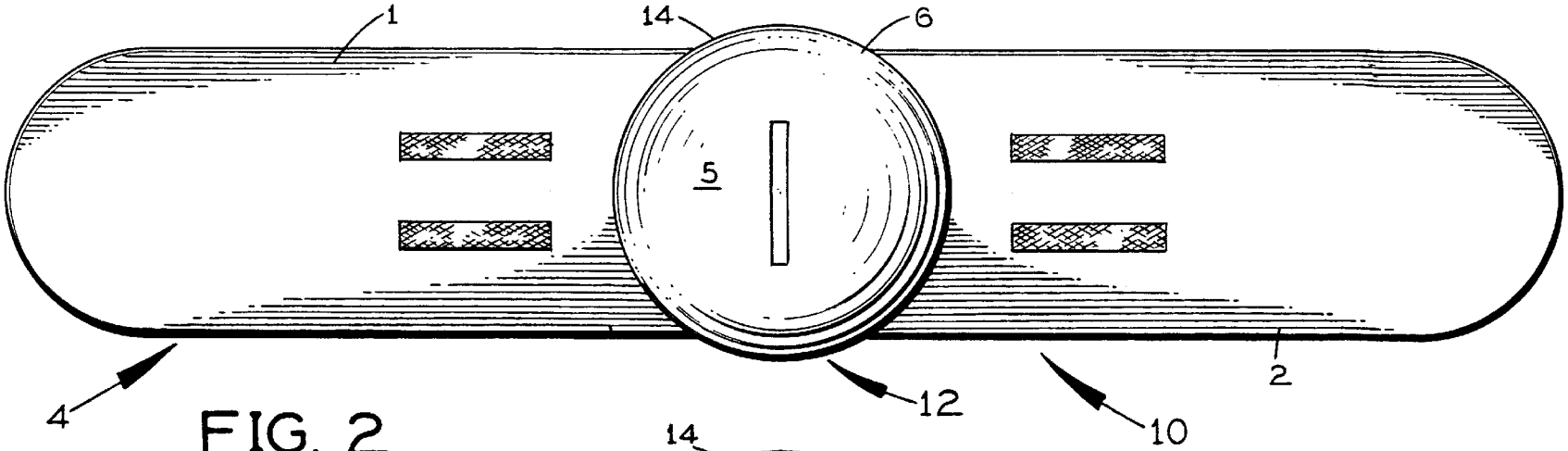
FIG. 2 is a top view of the apparatus in its straight position.
Figure 3:
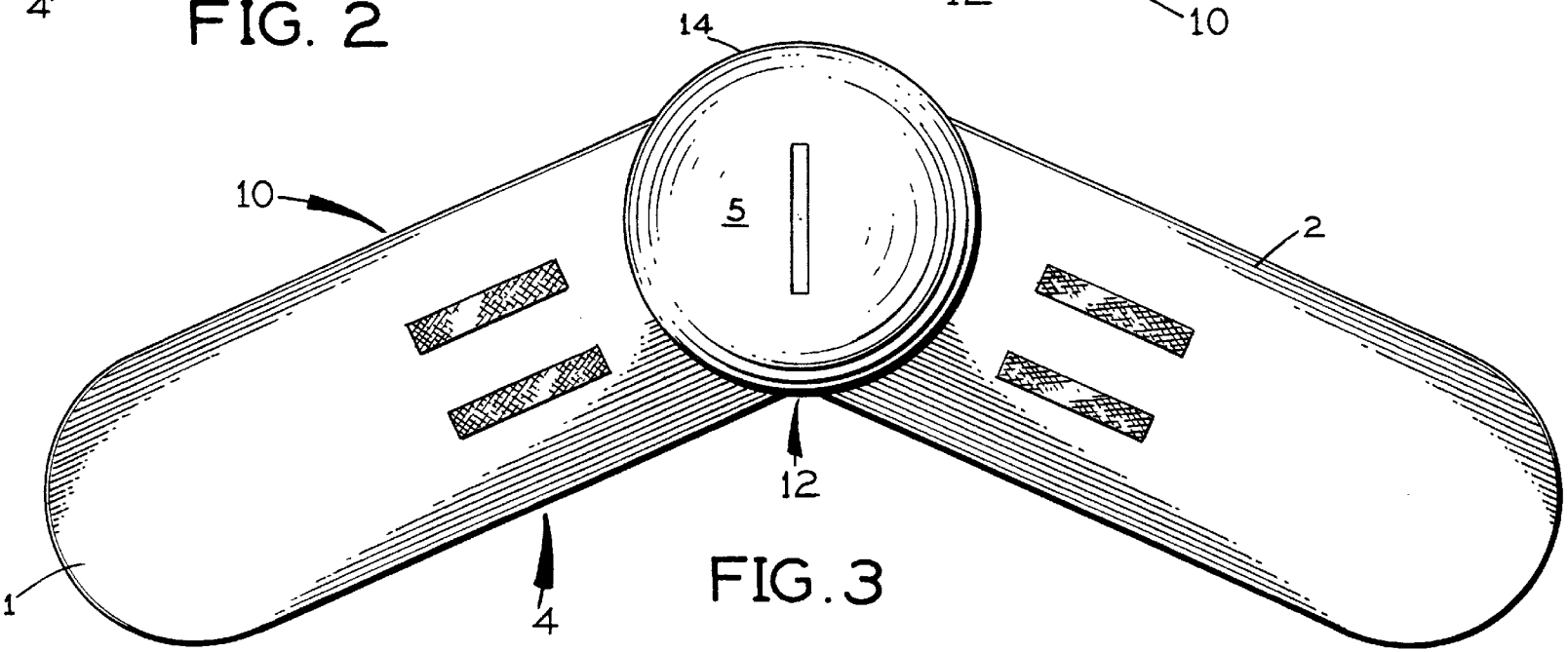
FIG. 3 is a top view of the apparatus in an angled position.

Referring to FIGS. 1–3, a snowboard apparatus 10 is disclosed, including a front board 1, a rear board 2, and a hinge assembly 12 interconnecting front board 1 and rear board 2 at a joint 14. Preferably, rear board 2 overlies front board 1 so that as apparatus 10 slides forward the friction at the joint 12 is minimized.

Front board 1 and rear board 2 overlap to define joint 12. Hinge assembly 12 includes a floating runner 7, and a rear board runner 8 secured to the forward end of rear board 2. Floating runner 7 and rear board runner 8 are each tubular members and the bottom of floating runner 7 and the top of rear board runner 8 are mitered. As a result of the mitering, front board 1 and rear board 2 are in a mutually aligned, straight position when they are overlapped and the bottom surfaces of boards 1 and 2 are substantially co-planar and lie flat against the snow.

Hinge assembly 12 further includes a tension nut 6 secured onto the rearward end upper face of front snowboard 1 forming a front board assembly 4, a separate tension screw 5 having a screw head 5*a*, and a tension spring 9. See FIG. 1. The tension screw 5 has a male thread and the tension nut 6 contains a female thread that complements the male thread of the tension screw 5. The rear board runner 8 is slid over and around tension nut 6. Tension screw 5 is inserted into and through tension spring 9, through floating runner 7, through rear board runner 8, and then screwed into the tension nut 6. A groove 21 is provided axially along the inner surface of the tension nut 6, and a tongue 21' extends along the inner surface of floating runner 7. Tongue 21' is inserted into groove 21 when hinge assembly 12 is assembled to fix floating runner 7 against rotation relative to tension nut 6. As tension screw 5 is screwed into tension nut 6, tension spring 9 is compressed between the tension screw head 5*a* and floating runner 7.

When the apparatus 10 is pivoted at its joint 12 (see FIG. 3), rear board 2 rotates in relation to front board 1. Due to the mitered edges of floating runner 7 and rear board runner 8, tension in spring 9 compresses as the two rotate. The compressed spring 9 then presses down on floating runner 7 and thus on rear board runner 8, biasing rear board 2 to return to a straight position in which it is mutually aligned with front board 1. In this way, apparatus 10 can bend at hinge assembly 12 in either rotational direction and then return on its own to the straight position.

In riding apparatus 10, the rider's feet attach directly to apparatus 10 by bindings. One foot attaches to the front board and the other foot attaches to the rear board. When making a turn, the rider can angle apparatus 10 about its hinge. By angling the board, the rider can cut a sharper turn. With this added maneuverability, the rider can perform a variety of tricks unavailable to conventional snowboard riders.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

PARTS LIST

1. Front board
2. Rear board
5. Tension screw
5*a*. Tension screw head
6. Tension nut
7. Floating runner
8. Rear board runner
9. Tension spring
10. Apparatus
12. Hinge assembly
14. Joint
21. Groove
21'. Tongue

I claim as my invention:

1. A snowboard for riding over snow, comprising:

a front board member having a front board forward end and a front board rearward end;

a rear board member having a rear board forward end and a rear board rearward end;

and a hinge assembly interconnecting said front board member and said rear board member;

wherein said rear board member overlaps said front board member such that said front board rearward end is underneath said rear board forward end to minimize drag at said joint when said snowboard moves over snow in a forward direction and wherein said hinge assembly comprises:

a floating runner including an upright tubular member having a mitered lower end;

a rear board runner secured to said rearboard forward end and including an upright tubular member having a mitered upper end, such that said front board and said rear board are mutually aligned when they are overlapped and the bottom surfaces of said front board and said rear board are substantially co-planar to lie evenly against snow;

a tension nut having a female thread and being secured onto the upper face of said front board rearward end;

a tension screw having a male thread that complements said female thread of said tension nut;

a tension spring;

wherein said tension screw extends through said tension spring, through said floating runner, through said rear board runner, and engagingly into said tension nut;

and fixing means fixing said floating runner against rotation relative to said tension nut;

such that upon rotating said front board member relative to said rear board member and out of mutual alignment, the mitering of said floating runner and of said rear board runner causes said tension spring to compress and exert pressure against said rear board runner, thereby biasing said rear board member to move toward mutual alignment with said front board member.

2. A snowboard according to claim 1, wherein said fixing means comprises a groove extending within said tension nut and a tongue within said floating runner fitting into said groove.

3. A snowboard according to claim 1, wherein said floating runner and said rear board runner are mitered such that when they are overlapped and such that when said front board member and said rear board member are mutually aligned, said front board and rear board bottom surfaces are substantially co-planar.

* * * * *